US008506270B2

(12) United States Patent
Soeda

(10) Patent No.: US 8,506,270 B2
(45) Date of Patent: Aug. 13, 2013

(54) VARIABLE DISPLACEMENT VANE PUMP

(75) Inventor: Jun Soeda, Fujisawa (JP)

(73) Assignees: Hitachi Automotive Systems, Ltd., Hitachinaka-shi (JP); Hitachi Automotive Systems Steering, Ltd., Saitama (JP)

( * ) Notice: Subject to any disclaimer, the term of this patent is extended or adjusted under 35 U.S.C. 154(b) by 318 days.

(21) Appl. No.: 12/955,580

(22) Filed: Nov. 29, 2010

(65) Prior Publication Data

US 2011/0142703 A1 Jun. 16, 2011

(30) Foreign Application Priority Data

Dec. 15, 2009 (JP) ..... 2009-283640
Oct. 13, 2010 (JP) ..... 2010-230133

(51) Int. Cl.
*F03C 2/00* (2006.01)
*F16K 15/00* (2006.01)

(52) U.S. Cl.
USPC ..... 418/29; 137/539

(58) Field of Classification Search
USPC ..... 418/29; 137/539, 539.5
See application file for complete search history.

(56) References Cited

U.S. PATENT DOCUMENTS 5,431,183 A * 7/1995 Seidl ..... 137/115.09
6,662,824 B2 12/2003 Inage et al.
6,675,823 B2 * 1/2004 Guo et al. ..... 137/115.04
6,892,758 B2 5/2005 Inage et al.
6,910,745 B2 * 6/2005 Inage et al. ..... 303/115.4
2002/0079000 A1 6/2002 Inage et al.
2003/0230929 A1 12/2003 Inage et al.
2011/0142703 A1 6/2011 Soeda

FOREIGN PATENT DOCUMENTS

JP 04-063874 U 5/1992
JP 2002-195429 A 7/2002
JP 2003-074725 A 3/2003
JP 2003074725 A * 3/2003
JP 2004-068811 A 3/2004
JP 2006207833 A * 8/2006
JP 2007-100769 A 4/2007
JP 2009-210071 A 9/2009
JP 2011-127431 A 6/2011
WO WO 2007/040169 A1 4/2007

* cited by examiner

*Primary Examiner* — Thomas Denion
*Assistant Examiner* — Laert Dounis
(74) *Attorney, Agent, or Firm* — Foley & Lardner LLP

(57) ABSTRACT

A variable displacement vane pump including a relief valve which includes a valve bore, a spherical valve element in the valve bore, a valve seat fixed onto one axial side of the valve bore and having a through hole and an annular seat surface on which the valve element is seated when the relief valve is in a closed position, a coil spring disposed on the other axial side of the valve bore, and a valve element retainer disposed between the valve element and the coil spring, wherein the seat surface is configured such that when the relief valve is in the closed position, a center of the valve element is located offset from a central axis of one winding seating portion of the coil spring which is disposed on an opposite side of the seat surface, in a radial direction of the valve bore.

7 Claims, 11 Drawing Sheets

VARIABLE DISPLACEMENT VANE PUMP

BACKGROUND OF THE INVENTION

The present invention relates to a variable displacement vane pump applicable to, for instance, a hydraulic power steering apparatus for automobiles.

As conventionally known, a variable displacement vane pump is provided with a relief valve in order to prevent hydraulic equipment from suffering from an excessive pressure rise. The relief valve is constructed such that a ball-shaped valve element is held by a valve element retainer and biased toward a valve seat by a coil spring. However, the relief valve has such a problem that when moving to an open position, the valve element and the valve element retainer are vibrated to cause noise.

Japanese Patent Application Unexamined Publication No. 2003-74725 discloses a relief valve for use in a variable displacement vane pump. The relief valve includes a ball retainer as a valve element retainer which is disposed within a valve bore in an inclined state such that an outer circumferential surface of the ball retainer comes into contact with an inner circumferential surface of the valve bore. With this construction, a friction force is produced between the outer circumferential surface of the ball retainer and the inner circumferential surface of the valve bore upon the contact therebetween, thereby suppressing occurrence of noise.

SUMMARY OF THE INVENTION

However, in the relief valve of the above conventional art, the friction force which is produced between the outer circumferential surface of the ball retainer and the inner circumferential surface of the valve bore upon the contact therebetween tends to be varied due to error in dimension of the ball retainer and the valve bore, error in assembly and extent of a hydraulic pressure applied to the valve element. As a result, there occurs such a problem that a relief pressure which acts on the relief valve to open the relief valve is made unstable.

It is an object of the present invention to solve the above-described technical problem in the conventional art and provide a variable displacement vane pump which is capable of both producing a relief pressure stable and suppressing occurrence of noise when the relief valve is opened.

In one aspect of the present invention, there is provided a variable displacement vane pump including:

a pump housing including a pump element accommodating space;

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor; and a hydraulic pressure control means for controlling the eccentric amount of the cam ring with respect to the rotor by controlling a hydraulic pressure in at least one of a pair of fluid pressure chambers which are formed on radially opposite sides of the cam ring; and a relief valve disposed within the pump housing so as to open and close a hydraulic passage disposed between the discharge passage and the suction passage, the relief valve including:

a valve bore disposed within the pump housing;

a spherical valve element disposed in the valve bore;

a valve seat fixedly disposed on one axial side of the valve bore relative to the valve element, the valve seat being formed with a through hole communicated with the discharge passage and with an annular seat surface on which the valve element is seated when the relief valve is in a closed position, the seat surface being located on a side of an open end of the through hole which faces to the valve element, a coil spring disposed on the other axial side of the valve bore relative to the valve element; and a valve element retainer disposed between the valve element and the coil spring so as to urge the valve element toward the valve seat by a restoring force of the coil spring owing to a compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the coil spring, wherein the seat surface of the valve seat is configured such that when the relief valve is in the closed position, a center of the valve element is located offset from a central axis of one winding seating portion of the coil spring which is disposed on an opposite side of the seat surface of the valve seat, in a radial direction of the valve bore.

In a further aspect of the present invention, there is provided a variable displacement vane pump including:

a pump housing including a pump element accommodating space;

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor; and a hydraulic pressure control means for controlling the eccentric amount of the cam ring with respect to the rotor by controlling a hydraulic pressure in at least one of a pair of fluid pressure chambers which are formed on radially opposite sides of the cam ring; and a relief valve disposed within the pump housing so as to open and close a hydraulic passage disposed between the discharge passage and the suction passage, the relief valve including:

a valve bore disposed within the pump housing;

a spherical valve element disposed in the valve bore;

a valve seat fixedly disposed on one axial side of the valve bore relative to the valve element, the valve seat being formed with a through hole which is communicated with the discharge passage and disposed coaxially with the valve bore, the valve seat being formed with an annular seat surface on which the valve element is seated when the relief valve is in a closed position, the seat surface being located on a side of an open end of the through hole which faces to the valve element, a coil spring disposed on the other axial side of the valve bore relative to the valve element, the coil spring having a first winding seating portion at one axial end thereof which is seated on a bottom of the valve bore coaxially with the valve bore, and a second winding seating portion at the other axial end thereof; and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the second winding seating portion of the coil spring, wherein the seat surface of the valve seat is configured such that when the relief valve is in the closed position, a center of the valve element is located offset from a central axis of the valve bore in a radial direction of the valve bore.

In a still further aspect of the present invention, there is provided a variable displacement vane pump including:

a pump housing including a pump element accommodating space;

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor; and a hydraulic pressure control means for controlling the eccentric amount of the cam ring with respect to the rotor by controlling a hydraulic pressure in at least one of a pair of fluid pressure chambers which are formed on radially opposite sides of the cam ring; and a relief valve disposed within the pump housing so as to open and close a hydraulic passage disposed between the discharge passage and the suction passage, the relief valve including:

a valve bore disposed within the pump housing;

a spherical valve element disposed in the valve bore;

a valve seat fixedly disposed on one axial side of the valve bore relative to the valve element, the valve seat being formed with a through hole communicated with the discharge passage and with an annular seat surface on which the valve element is seated when the relief valve is in a closed position, the seat surface being located on a side of an open end of the through hole which faces to the valve element, a coil spring disposed on the other axial side of the valve bore relative to the valve element; and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the coil spring, wherein the valve element retaining portion is configured to hold the valve element in a position where a center of the valve element is located offset from a central axis of the valve element retaining portion in a radial direction of the valve element retaining portion, and the valve element retaining portion is configured such that when the relief valve is in the closed position, the valve element retaining portion is located offset from a winding seating portion of the coil spring which is disposed on an opposite side of the seat surface of the valve seat, in the radial direction of the valve bore.

In a still further aspect of the present invention, there is provided a variable displacement vane pump including:

a pump housing including a pump element accommodating space;

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor; and a hydraulic pressure control means for controlling the eccentric amount of the cam ring with respect to the rotor by controlling a hydraulic pressure in at least one of a pair of fluid pressure chambers which are formed on radially opposite sides of the cam ring; and a relief valve disposed within the pump housing so as to open and close a hydraulic passage disposed between the discharge passage and the suction passage, the relief valve including:

a valve bore disposed within the pump housing;

a spherical valve element disposed in the valve bore;

a valve seat fixedly disposed on one axial side of the valve bore relative to the valve element, the valve seat being formed with a through hole communicated with the discharge passage and with an annular seat surface on which the valve element is seated when the relief valve is in a closed position, the seat surface being located on a side of an open end of the through hole which faces to the valve element, a coil spring disposed on the other axial side of the valve bore relative to the valve element; and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the coil spring, wherein the coil spring is configured such that a seating surface thereof to be located on an opposite side of the valve element retainer is inclined relative to an imaginary plane perpendicular to a central axis of the coil spring to thereby incline a central axis of the valve element retainer with respect to a central axis of the valve bore when the relief valve is in the closed position.

In a still further aspect of the present invention, there is provided a variable displacement vane pump including:

a pump housing including a pump element accommodating space;

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor; and a hydraulic pressure control means for controlling the eccentric amount of the cam ring with respect to the rotor by controlling a hydraulic pressure in at least one of a pair of fluid pressure chambers which are formed on radially opposite sides of the cam ring; and a relief valve disposed within the pump housing so as to open and close a hydraulic passage disposed between the discharge passage and the suction passage, the relief valve including:

a valve bore disposed within the pump housing;

a spherical valve element disposed in the valve bore;

a valve seat fixedly disposed on one axial side of the valve bore relative to the valve element, the valve seat being formed with a through hole communicated with the discharge passage and with an annular seat surface on which the valve element is seated when the relief valve is in a closed position, the seat surface being located on a side of an open end of the through hole which faces to the valve element, a coil spring disposed on the other axial side of the valve bore relative to the valve element; and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the coil spring, wherein the through hole of the valve seat includes an axial end portion to which the valve element is exposed, the axial end portion having a central axis offset from a central axis of the valve bore, and the seat surface of the valve seat is configured such that when the relief valve is in the closed position, a center of the valve element is located offset from the central axis of the axial end portion of the through hole of the valve seat.

According to the present invention, even when a relief valve is moved to an open position, a part of a valve element of the relief valve is still held in contact with a seat surface to thereby suppress vibration of the valve element. Therefore, it is possible to suppress occurrence of noise when the relief valve is moved to an open position, and stabilize a relief pressure.

The other objects and features of this invention will become understood from the following description with reference to the accompanying drawings.

DETAILED DESCRIPTION OF THE INVENTION

Figure 1:
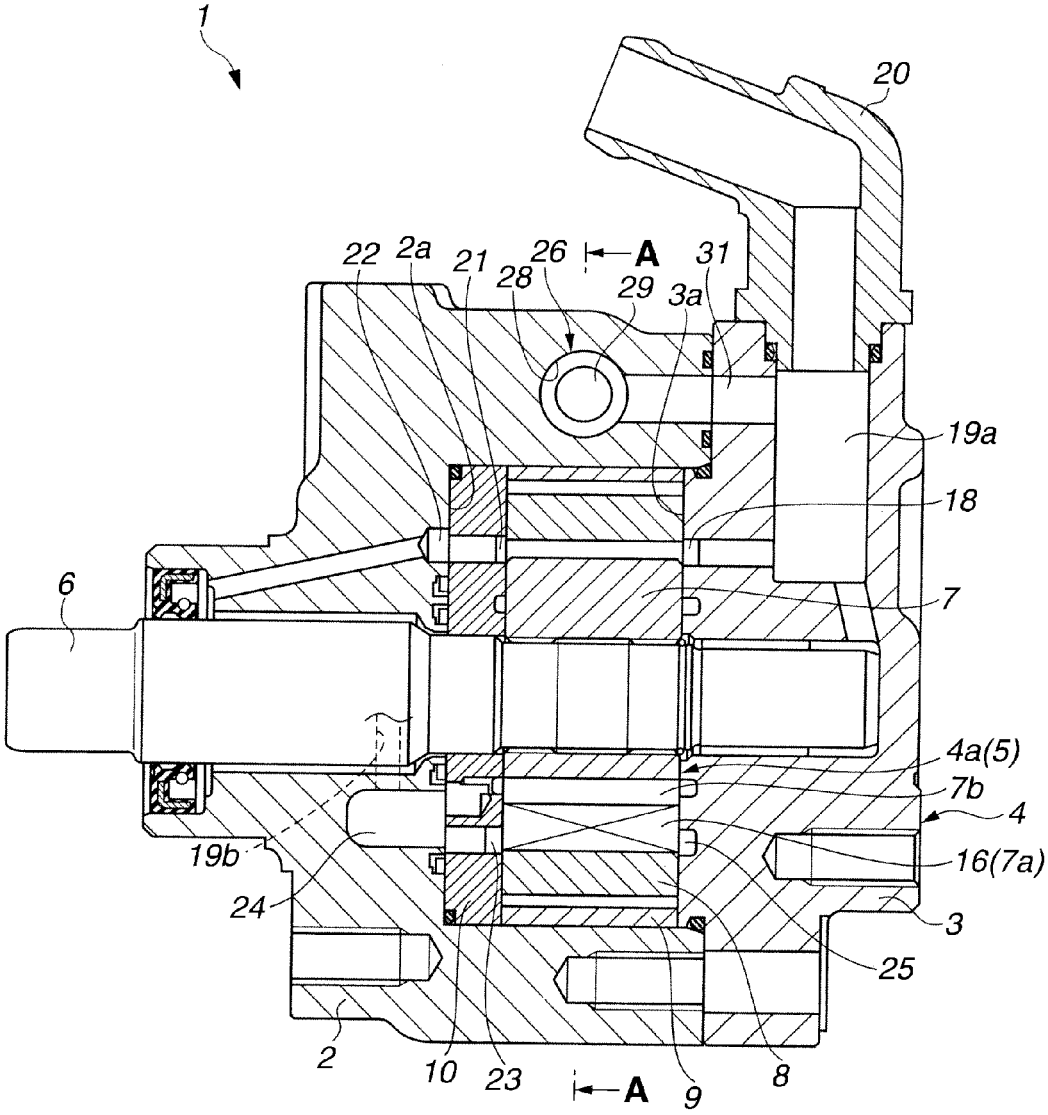
FIG. 1 is a sectional view of a variable displacement vane pump according to a first embodiment of the present invention, taken along an axial direction of the variable displacement vane pump.
Figure 2:
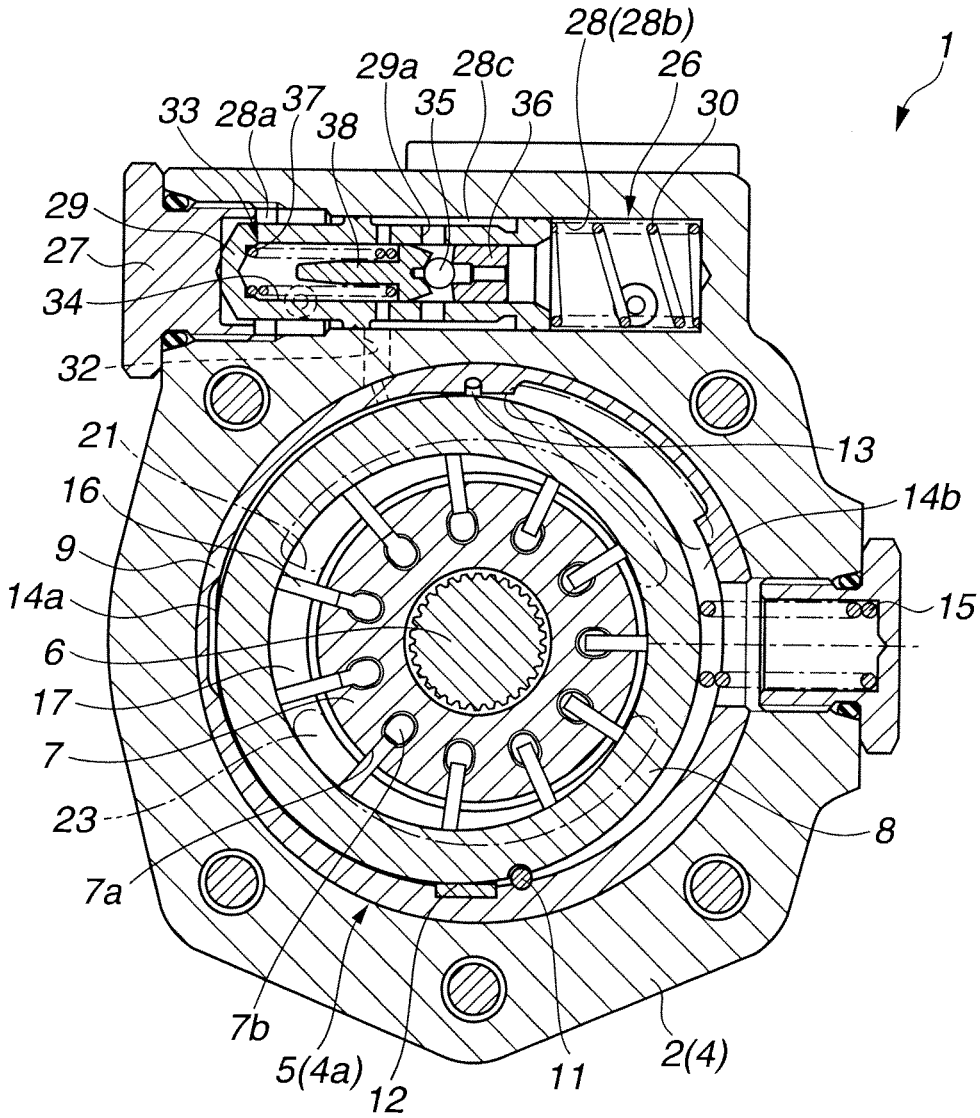
FIG. 2 is a cross section taken along line A-A shown in FIG. 1, showing a relief valve.

Referring to FIG. 1 and FIG. 2, there is shown a variable displacement vane pump according to a first embodiment of the present invention which can be applied to a hydraulic power steering apparatus for vehicles. FIG. 1 is a cross section taken along an axial direction of the variable displacement vane pump. FIG. 2 is a cross section taken along line A-A in FIG. 1.

As shown in FIG. 1 and FIG. 2, variable displacement vane pump 1 includes pump housing 4 formed from front housing 2 and rear housing 3 which are mated together. Pump element 5 is disposed within pump element accommodating space 4*a* formed in pump housing 4. Drive shaft 6 extends through pump element accommodating space 4*a*. Pump element 5 is rotationally driven by drive shaft 6 to thereby perform a pump function.

Pump element 5 includes rotor 7 which is connected to drive shaft 6 and rotatably driven by drive shaft 6, generally annular cam ring 8 disposed on a radial outside of rotor 7, generally annular adapter ring 9 accommodating cam ring 8 on an inner circumferential side thereof, and generally disk-shaped pressure plate 10 which is disposed within pump element accommodating space 4*a*. Cam ring 8 is disposed to be swingable in such a direction as to vary an eccentric amount of cam ring 8 with respect to rotor 7. Adapter ring 9 is fitted to an inner cylindrical surface of front housing 2 which defines pump element accommodating space 4*a* of pump housing 4. Pressure plate 10 is disposed on an inner bottom surface 2*a* of front housing 2 which defines pump element accommodating space 4*a* in cooperation with inner cylindrical surface of front housing 2.

Adapter ring 9 and pressure plate 10 are held in respective positions relative to pump housing 4 in a rotational direction of pump element 5 by positioning pin 11. Plate member 12 is disposed to be spaced from positioning pin 11 in a clockwise direction in FIG. 2. That is, plate member 12 is disposed on the side of first fluid pressure chamber 14*a* as explained later. Plate member 12 serves as both a fulcrum of swing movement of cam ring 8 and a seal member for sealing between cam ring 8 and adapter ring 9.

Seal member 13 which seals between adapter ring 9 and cam ring 8 is also disposed on the inner circumferential surface of adapter ring 9 so as to be opposed to plate member 12 in a radial direction of adapter ring 9. Seal member 13 and plate member 12 cooperate with each other to define a pair of fluid pressure chambers 14*a*, 14*b* between cam ring 8 and adapter ring 9. That is, first fluid pressure chamber 14*a* and second fluid pressure chamber 14*b* are formed on radially opposite sides of cam ring 8. Cam ring 8 is swingably moved by a pressure difference between first and second fluid pressure chambers 14*a*, 14*b*, so that the eccentric amount of cam ring 8 with respect to rotor 7 is varied. Cam ring 8 is always biased by return spring 15 in a direction in which the eccentric amount of cam ring 8 becomes maximum.

Rotor 7 has a plurality of slots 7*a* which are formed along an outer circumferential portion of rotor 7 at equivalent pitches. Slots 7*a* are provided in the form of a cutout extending along a radial direction of rotor 7. Each of slots 7*a* accommodates generally plate-shaped vane 16 which is movable in the radial direction of rotor 7 so as to project from slot 7*a* and retract into slot 7*a*. Vanes 16 accommodated in slots 7*a* are disposed in the circumferential direction of rotor 7 and divide an annular space between cam ring 8 and rotor 7 into a plurality of pump chambers 17. Thus, vanes 16 cooperate with cam ring 8 and rotor 7 to define pump chambers 17. By rotationally driving rotor 7 by drive shaft 6 in the counter-clockwise direction in FIG. 2, pump chambers 17 are displaced in the circumferential direction of rotor 7 while being varied in volume to thereby perform pump action. Each of vanes 16 is pressed against an inner circumferential surface of cam ring 8 by a hydraulic pressure of a working oil to be introduced into back pressure chamber 7*b* which is formed on a radial inner side of slot 7*a*.

Rear housing 3 has first suction port 18 on inside surface 3*a* thereof exposed to pump element accommodating space 4*a*. First suction port 18 is provided in the form of a cutout which extends along the circumferential direction of rotor 7 and has a generally crescent shape in a plan view. First suction port 18 is disposed at a portion of inside surface 3*a* of rear housing 3 which corresponds to a suction region in which the volume of respective pump chambers 17 is gradually increased with rotation of rotor 7. First suction port 18 is communicated with suction passage 19*a* which extends in rear housing 3. With this construction, the working oil introduced into suction passage 19*a* through suction pipe 20 which is connected to a reservoir tank (not shown) is sucked into respective pump chambers 17 in the suction region by the pump sucking action.

Pressure plate 10 has second suction port 21 on a surface thereof which is opposed to rotor 7. Second suction port 21 is disposed to be opposed to first suction port 18 and provided in the form of a cutout having substantially the same shape as that of first suction port 18. Second suction port 21 is communicated with circulation passage 22 formed in front housing 2. Circulation passage 22 is communicated with a recessed portion receiving a seal member which seals a space between front housing 2 and drive shaft 6. An excess oil in the recessed portion receiving the seal member is supplied to respective pump chambers 17 by the pump sucking action in the suction region, so that the excess oil can be prevented from leaking out to outside.

Further, pressure plate 10 has first discharge port 23 on a surface thereof which is opposed to rotor 7. First discharge port 23 is provided in the form of a cutout which extends along the circumferential direction of rotor 7 and has a generally crescent shape in a plan view. First discharge port 23 is disposed at a portion of the surface of pressure plate 10 opposed to rotor 7 which corresponds to a discharge region in which the volume of respective pump chambers 17 is gradually decreased with rotation of rotor 7. First discharge port 23 is communicated with discharge passage 19*b* via pressure chamber 24 formed in front housing 2. Pressure chamber 24 is provided in the form of a recess on inner bottom surface 2*a* of front housing 2 which is opposed to pressure plate 10. With this construction, the working oil discharged from respective pump chambers 17 in the discharge region by the pump action is discharged through pressure chamber 24 and discharge passage 19*b* to an outside of pump housing 4 and then fed to a hydraulic power cylinder (not shown) of the power steering apparatus. Pressure plate 10 is urged toward the side of rotor 7 by the hydraulic pressure in pressure chamber 24.

Rear housing 3 includes second discharge port 25 which is formed on inside surface 3*a* so as to be opposed to first discharge port 23. Second discharge port 25 has substantially the same shape as that of first discharge port 23. Thus, first and second discharge ports 23, 25 are symmetrically disposed so as to be opposed in the axial direction of the variable displacement vane pump and sandwich pump chambers 17 therebetween. First and second suction ports 18, 21 also are symmetrically disposed in the same configuration. With this arrangement, pressure balance on both sides of respective pump chambers 17 in the axial direction of the variable displacement vane pump can be kept suitable.

Front housing 2 has control valve 26 on an inside of an upper end portion thereof. Control valve 26 is a pressure control valve which controls a pump discharge pressure. Control valve 26 extends in a direction perpendicular to drive shaft 6, i.e., in the left-and-right direction in FIG. 2). Control valve 26 includes valve bore 28 which extends from the left side toward the right side in FIG. 2 and has an open end on the left end side as shown in FIG. 2. The open end of valve bore 28 is closed by plug 27. Valve bore 28 accommodates generally cylindrical hollow spool 29 which has one closed end and is axially slidable in valve bore 28. Spool 29 is always biased by control valve spring 30 toward plug 27.

Spool 29 divides an inside space of valve bore 28 into high pressure chamber 28*a*, intermediate pressure chamber 28*b* and low pressure chamber 28*c*. High pressure chamber 28*a* is disposed between plug 27 and spool 29, into which a hydraulic pressure on an upstream side of a metering orifice (not shown) formed in discharge passage 19*b* (that is, a hydraulic pressure in pressure chamber 24) is introduced. Intermediate pressure chamber 28*b* accommodates control valve spring 30, into which a hydraulic pressure on a downstream side of the metering orifice is introduced. Low pressure chamber 28*c* is formed on an outer circumferential side of spool 29, into which a pump suction pressure is introduced from suction passage 19*a* through low pressure passage 31. Spool 29 is movable in the axial direction on the basis of a pressure difference between intermediate pressure chamber 28*b* and high pressure chamber 28*a*.

Specifically, when the pressure difference between intermediate pressure chamber 28*b* and high pressure chamber 28*a* is relatively small so that spool 29 is placed on the side of plug 27, a relatively low hydraulic pressure in low pressure chamber 28*c* is introduced into first fluid pressure chamber 14*a* through communication passage 32 which is opened into low pressure chamber 28*c* to thereby communicate first fluid pressure chamber 14*a* and valve bore 28 with each other. On the other hand, when the pressure difference between intermediate pressure chamber 28*b* and high pressure chamber 28*a* is increased so that spool 29 is moved in the axial direction against the biasing force of control valve spring 30, the fluid communication between low pressure chamber 28*c* and first fluid pressure chamber 14*a* is gradually blocked and high pressure chamber 28*a* is allowed to communicate with first fluid pressure chamber 14*a* through communication passage 32. As a result, a relatively high hydraulic pressure in high pressure chamber 28*a* is introduced into first fluid pressure chamber 14*a*. That is, the hydraulic pressure in low pressure chamber 28*c* or the hydraulic pressure in high pressure chamber 28*a* is selectively introduced into first fluid pressure chamber 14*a*.

The pump suction pressure is always introduced into second fluid pressure chamber 14*b*. When the hydraulic pressure in low pressure chamber 28*c* is introduced into first fluid pressure chamber 14*a*, cam ring 8 is moved to a position where the eccentric amount of cam ring 8 with respect to rotor 7 becomes maximum (i.e., the left side position in FIG. 2), by the biasing force of return spring 15. As a result, a pump discharge flow rate becomes maximum. On the other hand, when the hydraulic pressure in high pressure chamber 28*a* is introduced into first fluid pressure chamber 14*a*, cam ring 8 is allowed to swing against the biasing force of return spring 15 so as to reduce a volume of second fluid pressure chamber 14*b*, by the hydraulic pressure in first fluid pressure chamber 14*a*. As a result, the eccentric amount of cam ring 8 with respect to rotor 7 is decreased to thereby reduce the pump discharge flow rate.

As shown in FIG. 2, spool 29 has relief valve 33 on an inside thereof. Relief valve 33 acts to circulate the working oil to suction passage 19*a* through low pressure chamber 28*c* and low pressure passage 31 when the hydraulic pressure in intermediate pressure chamber 28*b*, that is, the hydraulic pressure on the side of the power steering apparatus (i.e., on the side of load) becomes not less than a predetermined value. In other words, relief valve 33 is operative to open and close the hydraulic passage disposed between discharge passage 19*b* and suction passage 19*a*.

Figure 3:
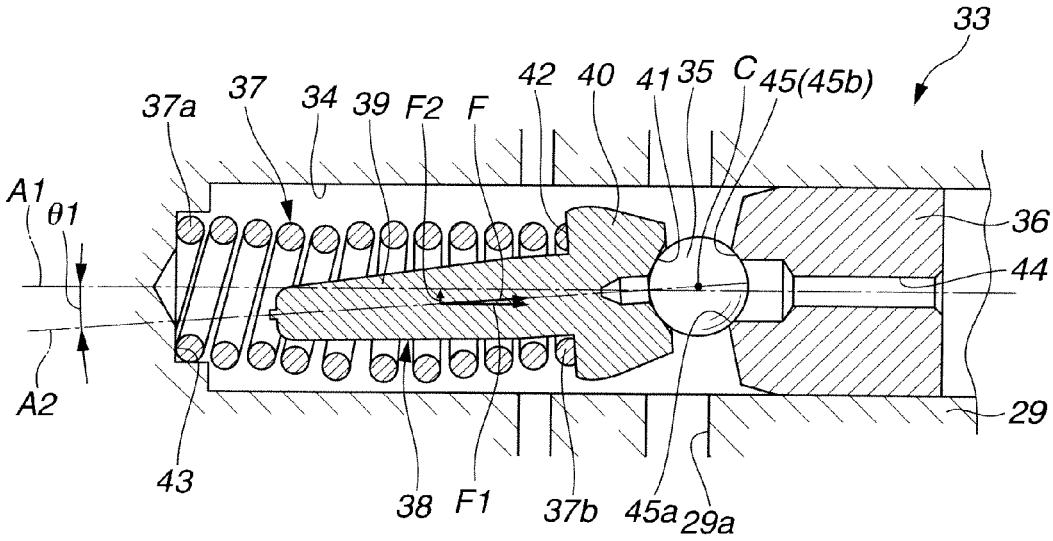
FIG. 3 is an enlarged view of the relief valve shown in FIG. 2, showing a valve seat.

FIG. 3 is an enlarged cross section of relief valve 33, taken along a central axis thereof, and shows details of relief valve 33.

As shown in FIG. 3, relief valve 33 includes generally cylindrical valve bore 34 defined by an inner peripheral surface of spool 29, relief hole 29*a* which is formed in spool 29 so as to communicate valve bore 34 and low pressure chamber 28*c* with each other, ball 35 (i.e., a spherical valve element) which is disposed in valve bore 34, valve seat 36 which is fixedly fitted into one axial side of valve bore 34 relative to ball 35, relief valve spring 37 which is a coil spring disposed in a compressively deformed state on the other axial side of valve bore 34 relative to ball 35, and retainer (i.e., a valve element retainer) 38 which is disposed between ball 35 and relief valve spring 37 so as to urge ball 35 toward valve seat 36 by a restoring force of relief valve spring 37 owing to the compressive deformation.

Retainer 38 includes shaft portion 39 and ball retaining portion (i.e., valve element retaining portion) 40 which is connected with one axial end of shaft portion 39 on the side of valve seat 36. Shaft portion 39 is inserted into a radial inside space of relief valve spring 37 and serves as a spring engaging portion which is engaged with relief valve spring 37 and restricts a relative displacement of retainer 38 and relief valve spring 37. Ball retaining portion 40 has a diameter larger than that of shaft portion 39 and is seated on one winding seating portion 37*b* of relief valve spring 37 which is located at one end of relief valve spring 37.

Shaft portion 39 is formed so as to gradually increase the diameter toward ball retaining portion 40. That is, shaft portion 39 is tapered from the root toward the other axial end of valve bore 34. An outer circumferential surface of a root of shaft portion 39 connected with ball retaining portion 40 is opposed to an inner circumferential surface of one winding seating portion 37*b* of relief valve spring 37 in the radial direction of shaft portion 39. With this construction, when the outer circumferential surface of a root of shaft portion 39 comes into abutting contact with the inner circumferential surface of one winding seating portion 37*b* of relief valve spring 37, a relative displacement between one wound portion 37*b* and retainer 38 in the radial direction thereof can be restricted.

Ball retaining portion 40 has ball retaining recess (i.e., valve element retaining recess) 41 on an end surface which is located on the side opposed to shaft portion 39. Ball 35 is retained in ball retaining recess 41. The other end surface of ball retaining portion 40 and the outer circumferential surface of the root of shaft portion 39 form step portion 42 therebetween on which one winding seating portion 37*b* of relief valve spring 37 is seated. Ball retaining recess 41 is defined by a shallow concave conical surface which is in rotation symmetry with respect to central axis A2 of retainer 38. By seating ball 35 on ball retaining recess 41, a relative displacement of ball 35 and retainer 38 in the radial direction thereof is restricted so that center C of ball 35 lies on central axis A2 of retainer 38.

Disposed on a bottom of valve bore 34 is spring seat portion 43 on which the other winding seating portion 37*a* (i.e., the other end portion) of relief valve spring 37 located on the side opposite to valve seat 36 is seated. Valve bore 34 is provided in the form of a recess having a shallow cylindrical shape. A central axis of spring seat portion 43 is aligned with central axis A1 of valve bore 34. By seating the other winding seating portion 37*a* of relief valve spring 37 on spring seat portion 43, a central axis of the other winding seating portion 37*a* is brought into alignment with central axis A1 of valve bore 34.

Valve seat 36 is formed along central axis A1 of valve bore 34. Valve seat 36 includes through hole 44 communicated with discharge passage 19*b* via intermediate pressure chamber 28*b*, and annular seat surface 45 formed on a periphery of an opening at one axial end of through hole 44 which is opposed to ball 35. Through hole 44 is disposed coaxially with central axis A1 of valve bore 34. When ball 35 is seated on seat surface 45, relief valve 33 is placed in a closed position.

Figure 5:
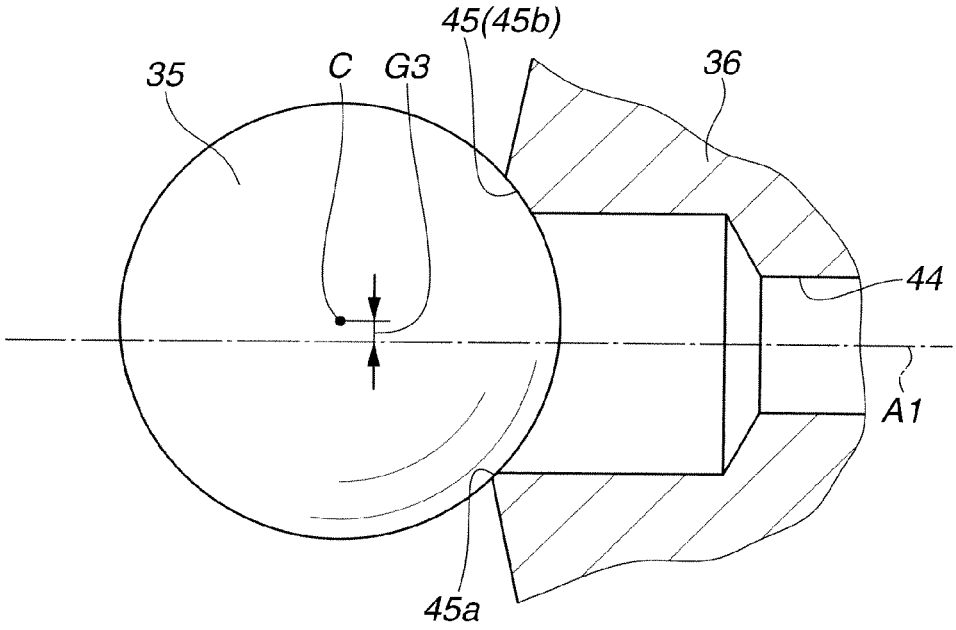
FIG. 5 is a diagram showing a ball of the relief valve which is seated on the seat surface shown in FIG. 4.

Seat surface 45 is configured such that when relief valve 33 is in the closed position, i.e., ball 35 is seated on seat surface 45, center C of ball 35 is allowed to be offset from central axis A1 of valve bore 34 while is common to central axes of the other winding seating portion 37*a* and through hole 44, by predetermined amount G3 in the radial direction of valve bore 34 as shown in FIG. 5. With this configuration, retainer 38 with ball retaining portion 40 is disposed angularly offset from central axis A1 of valve bore 34 such that central axis A2 of retainer 38 is inclined relative to central axis A1 of valve bore 34 by angle θ1.

Figure 4:
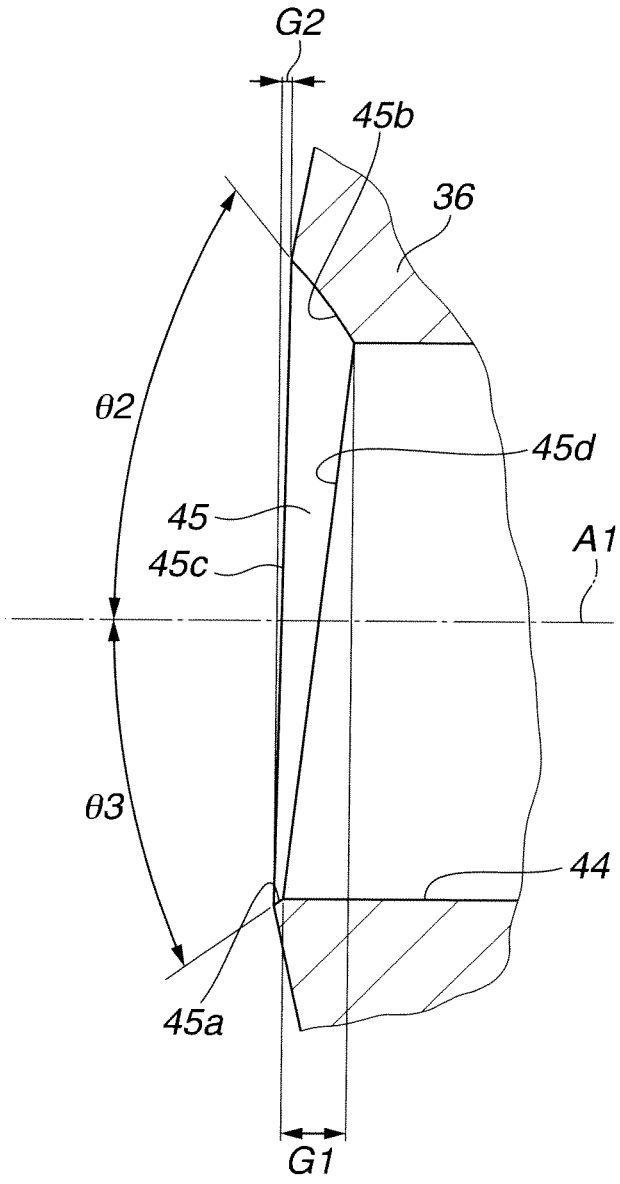
FIG. 4 is a an enlarged view of a seat surface of the valve seat shown in FIG. 3.

FIG. 4 and FIG. 5 are enlarged views showing seat surface 45 of valve seat 36 in detail, respectively. FIG. 4 is an enlarged section of an essential part of valve seat 36. FIG. 5 is an enlarged section of valve seat 36, showing the closed state of relief valve 33 in which ball 35 is seated on seat surface 45 of valve seat 36.

Specifically, as shown in FIG. 4 and FIG. 5, seat surface 45 is formed as a part of a concave spherical surface having a same radius of curvature as that of a spherical surface of ball 35, and a center of the sphere defined by seat surface 45 is offset from central axis A1 of valve bore 34 by predetermined amount G3 in the radial direction of valve bore 34. That is, seat surface 45 has an arcuate shape in a section taken in the direction of central axis A1 of valve bore 34 which has a same curvature as that of the spherical surface of ball 35. Seat surface 45 has a width in a radial direction thereof which is gradually varied along a circumferential direction of seat surface 45.

More specifically, seat surface 45 includes narrower width portion 45*a* including a minimum width portion and wider width portion 45*b* including a maximum width portion. Narrower width portion 45*a* and wider width portion 45*b* are disposed in positions diametrically opposed to each other in the radial direction of seat surface 45. Seat surface 45 is inclined toward wider width portion 45*b* in the radial direction of seat surface 45 and toward an inside of through hole 44 in the axial direction of valve bore 34 (that is, in such a direction as to be spaced apart from the other winding seating portion 37*a* of relief valve spring 37) and varied in width to be gradually reduced from wider width portion 45*b* toward narrower width portion 45*a* in the circumferential direction of seat surface 45. In other words, seat surface 45 is formed such that a distance from the other winding seating portion 37*a* of relief valve spring 37 in the axial direction of valve bore 34 is varied in the circumferential direction of seat surface 45.

Still more specifically, as shown in FIG. 4, seat surface 45 has outer peripheral edge 45*c* which is inclined such that a distance from the other winding seating portion 37*a* of relief valve spring 37 to outer peripheral edge 45*c* in the axial direction of valve bore 34 becomes reduced from wider width portion 45*b* toward narrower width portion 45*a*. In addition, seat surface 45 has inner peripheral edge 45*d* which is inclined such that a distance from the other winding seating portion 37*a* of relief valve spring 37 to inner peripheral edge 45*d* in the axial direction of valve bore 34 becomes reduced from wider width portion 45*b* toward narrower width portion 45*a* to a larger extent than outer peripheral edge 45*c*. That is, inner peripheral edge 45*d* has an inclination angle larger than that of outer peripheral edge 45*c*. In other words, inner peripheral edge 45*d* located at wider width portion 45*b* is disposed offset from inner peripheral edge 45*d* located at narrower width portion 45*a* toward the side opposite to the other winding seating portion 37*a* of relief valve spring 37 by predetermined offset amount G1. In addition, outer peripheral edge 45*c* located at wider width portion 45*b* is disposed offset from outer peripheral edge 45*c* located at narrower width portion 45*a* toward the side opposite to the other winding seating portion 37*a* of relief valve spring 37 by predetermined offset amount G2. Predetermined offset amount G1 of inner peripheral edge 45*d* is larger than predetermined offset amount G2 of outer peripheral edge 45*c*. Further, wider width portion opening angle θ2 formed between central axis A1 of valve bore 34 and an imaginary line extending between outer peripheral edge 45*c* and inner peripheral edge 45*d* at wider width portion 45*b* is larger than narrower width portion opening angle θ3 formed between central axis A1 of valve bore 34 and an imaginary line extending between outer peripheral edge 45*c* and inner peripheral edge 45*d* at narrower width portion 45*a*.

Further, seat surface 45 is formed by pressing a punch having a predetermined shape onto an open end periphery of through hole 44 which is to be located on the side of ball 35. Specifically, the punch has at least a part of a spherical surface which has a same curvature as that of the spherical surface of ball 35*a*, and the at least a part of a spherical surface serves as a forming surface for forming seat surface 45. By forming seat surface 45 by the punch, ball 35 and seat surface 45 are brought into hermetical face contact with each other when relief valve 33 is in the closed position.

An operation of thus constructed variable displacement vane pump 1 is explained hereinafter. When relief valve 33 is in the closed position as shown in FIG. 3, center C of ball 35 is located offset from central axis A1 of valve bore 34 toward the side of wider width portion 45*b* of seat surface 45 and central axis A2 of retainer 38 is inclined relative to central axis A1 of valve bore 34 so as to be oriented toward the side of wider width portion 45*b* of seat surface 45. As a result, biasing force F of relief valve spring 37 acts on retainer 38 in the direction of central axis A2 toward seat surface 45 so that ball 35 is strongly pressed against wider width portion 45*b* of seat surface 45. In other words, retainer 38 is urged against the hydraulic pressure in through hole 44 by axial component F1 of biasing force F and allowed to press ball 35 onto wider width portion 45*b* of seat surface 45 by radial component F2 of biasing force F.

Figure 6:
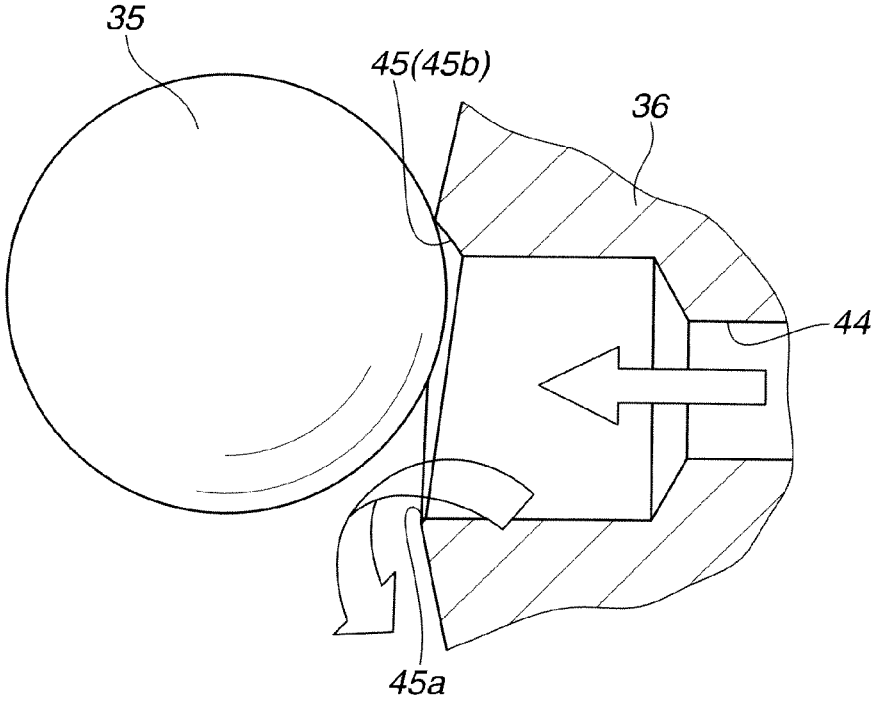
FIG. 6 is an explanatory diagram showing an attitude of the ball when the relief valve shown in FIG. 3 is opened.

When the hydraulic pressure in intermediate pressure chamber 28*b* is increased to exceed a predetermined relief pressure, ball 35 is allowed to move apart from narrower width portion 45*a* of seat surface 45 while keeping partial contact with wider width portion 45*b* of seat surface 45 as shown in FIG. 6. Thus, relief valve 33 is moved to an open position in which the working oil is permitted to flow from through hole 44 into valve bore 34 through a clearance generated between ball 35 and narrower width portion 45*a* as indicated by arrows in FIG. 6. That is, when relief valve 33 is moved to the open position, ball 35 is stably supported by wider width portion 45*b* of seat surface 45 while keeping the partial contact therewith and being backed up of retainer 38. As a result, occurrence of vibration of ball 35 can be suppressed. Meanwhile, as shown in FIG. 3, there is provided a sufficient clearance between an outer circumferential surface of ball retaining portion 40 of retainer 38 and an inner circumferential surface of valve bore 34 in order to prevent interference therebetween when relief valve 33 is moved to the open position.

As be understood from the above description, variable displacement vane pump 1 according to the first embodiment can suppress vibration of ball 35 and occurrence of noise due to the vibration of ball 35 when relief valve 33 is moved to the open position, without making relief pressure of relief valve 33 unstable.

Incidentally, seat surface 45 of valve seat 36 is not limited to a part of the concave spherical surface having the same radius of curvature as that of the spherical surface of ball 35 in the first embodiment. Seat surface 45 may be formed as a part of a concave spherical surface having a radius of curvature different from that of the spherical surface of ball 35.

Figure 7:
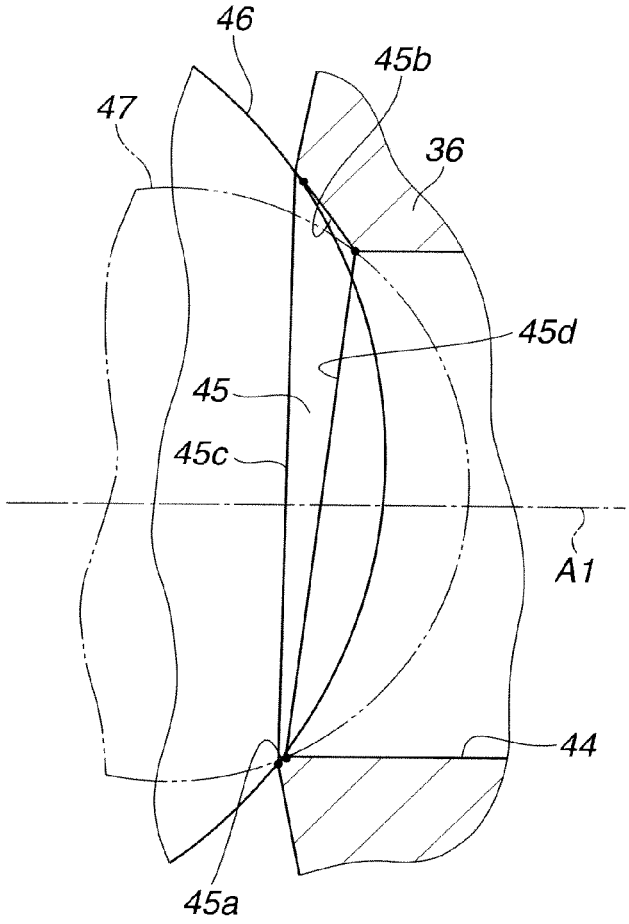
FIG. 7 is a diagram showing a modification of the first embodiment.

FIG. 7 is a diagram showing modifications of the first embodiment, in which balls with spherical surfaces each having a radius of curvature different from that of seat surface 45 are seated on seat surface 45. In FIG. 7, ball 46 with the spherical surface having a radius of curvature larger than that of seat surface 45 is indicated by solid line, and ball 47 with the spherical surface having a radius of curvature smaller than that of seat surface 45 is indicated by broken line.

Specifically, in the modifications using balls 46, 47 with spherical surfaces respectively having a radius of curvature different from that of seat surface 45 as shown in FIG. 7, centers of respective balls 46, 47 are located offset from central axis A1 of valve bore 34 toward the side of wider width portion 45*b* when relief valve 33 is in the closed position, similarly to the first embodiment. Accordingly, these modifications can attain substantially the same effect as that of the first embodiment.

Further, the present invention is not limited to the first embodiment in which the central axis of through hole 44 of valve seat 36 extends along central axis A1 of valve bore 34, and the center of the sphere defining concave spherical seat surface 45 of valve seat 36 is located offset from central axis A1 which is common to valve bore 34 and through hole 44. However, in the present invention, it is not necessary to arrange the central axis of through hole 44 and the center of the sphere defining concave spherical seat surface 45 in the offset relation from each other as explained in the first embodiment. For instance, both the central axis of the through hole of valve seat 36 and the center of the sphere defining the concave spherical seat surface of valve seat 36 which are aligned with each other may be located offset from central axis A1 of valve bore 34 in the radial direction of valve bore 34. In such a case, substantially the same effect as that of the first embodiment can be attained.

Figure 8:
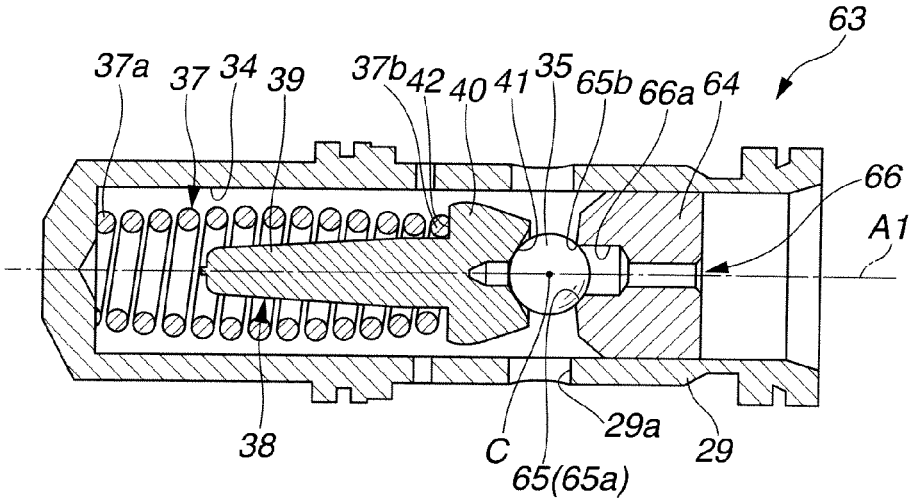
FIG. 8 is a view similar to FIG. 3, but shows a relief valve of the variable displacement vane pump according to a second embodiment of the present invention.
Figure 9:
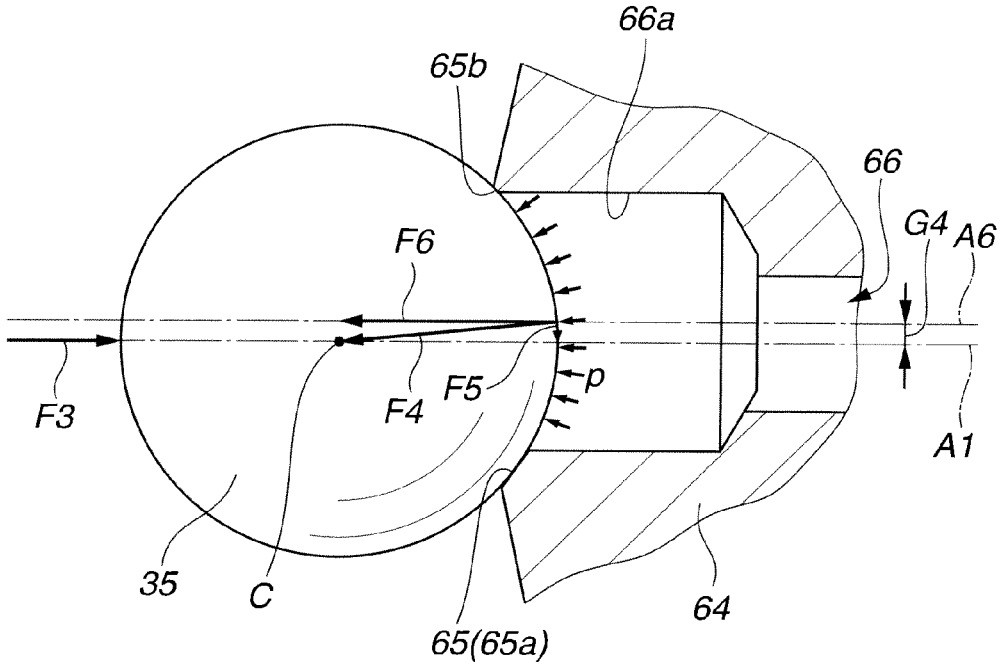
FIG. 9 is an enlarged view of an essential part of the relief valve shown in FIG. 8.
Figure 10:
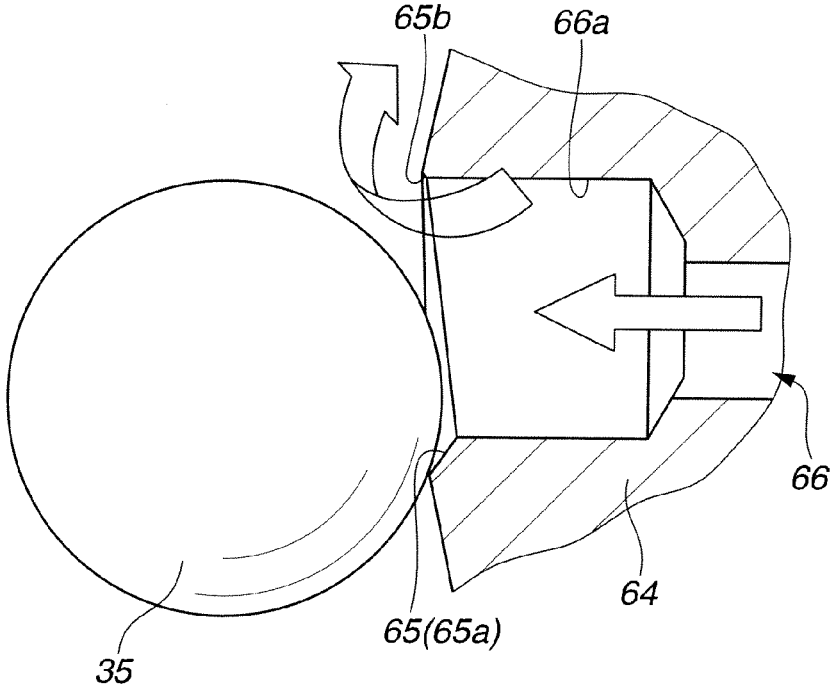
FIG. 10 is an explanatory diagram showing an attitude of a ball of the relief valve shown in FIG. 9 when the relief valve is opened.

FIG. 8 to FIG. 10 show a relief valve of the variable displacement vane pump according to a second embodiment. FIG. 8 is a cross section taken along an axial direction of the relief valve in a closed position. FIG. 9 is an enlarged diagram of FIG. 8, showing an essential part of the relief valve. FIG. 10 is an explanatory diagram showing that the relief valve shown in FIG. 9 is in an open position. Like reference numerals denote like parts, and therefore, detailed explanations therefor are omitted.

The second embodiment as shown in FIG. 8 to FIG. 10 differs from the first embodiment in construction of seat surface 65 of valve seat 64 of relief valve 63 and construction of through hole 66 of valve seat 64. That is, seat surface 65 is formed such that when relief valve 63 is placed in the closed position, center C of ball 35 lies on central axis A1 of valve bore 34. In addition, through hole 66 includes large diameter portion 66*a* which is disposed at an end portion of through hole 66 and opened toward ball 35. Large diameter portion 66*a* has a generally circular section and central axis A6 offset from central axis A1 of valve bore 34.

Specifically, seat surface 65 of relief valve 63 in the second embodiment is formed into an annular shape in a plan view and formed as a part of a concave spherical surface having a same radius of curvature as that of a spherical surface of ball 35. As shown in FIG. 9, seat surface 65 is configured such that when ball 35 is seated on seat surface 65, center C of ball 35 is located offset from central axis A6 of large diameter portion 66*a* of through hole 66. Seat surface 65 has an arcuate shape in a sectional view taken in the direction of central axis A1 of valve bore 34 which has a same curvature as that of the spherical surface of ball 35. Similarly to the first embodiment, seat surface 65 has a width which extends in a radial direction of seat surface 65 in a plan view of seat surface 65 and is gradually varied in a circumferential direction of seat surface 65. That is, seat surface 65 is formed as a part of the concave spherical surface having a center offset from central axis A6 of large diameter portion 66*a* of through hole 66. In FIG. 8 to FIG. 10, reference numeral 65*a* denotes a wider width portion including a maximum width and reference numeral 65*b* denotes a narrower width portion including a minimum width.

An operation of the variable displacement vane pump according to the second embodiment is now explained. When relief valve 63 is placed in the closed position as shown in FIG. 9, biasing force F3 of relief valve spring 37 acts in a direction extending along central axis A1 of valve bore 34. However, in this state, center C of ball 35 is located offset from central axis A6 of large diameter portion 66*a* of through hole 66 to which a part of the outer surface of ball 35 is exposed. Owing to the offset relation between center C of ball 35 and central axis A6 of large diameter portion 66*a*, pressing force F4 which is produced by the hydraulic pressure "p" in large diameter portion 66*a* and acts on ball 35 in an opening direction of relief valve 63 is inclined toward wider width portion 65*a* with respect to central axis A6. That is, ball 35 is urged in the opening direction of relief valve 63 by axial component F6 of pressing force F4 which extends along central axis A6 of large diameter portion 66*a*, while being pressed against a part of wider width portion 65*a* by radial component F5 of pressing force F4 which extends in a direction perpendicular to central axis A6 of large diameter portion 66*a*.

When the hydraulic pressure in large diameter portion 66*a* (i.e., the hydraulic pressure in intermediate pressure chamber 28*b*) is increased to exceed a predetermined relief pressure, ball 35 kept pressed on the part of wider width portion 65*a* by radial component F5 of pressing force F4 is allowed to move apart from narrower width portion 65*b* of seat surface 65 while keeping partial contact with wider width portion 65*a* of seat surface 65 as shown in FIG. 10. As a result, the working oil is permitted to flow from through hole 66 into valve bore 34 through a clearance generated between ball 35 and narrower width portion 65*b* as indicated by arrows in FIG. 10. Therefore, similarly to the first embodiment, it is possible to suppress occurrence of vibration of ball 35 when relief valve 63 is moved to the open position. The second embodiment can attain substantially the same effect as that of the first embodiment.

Figure 11:
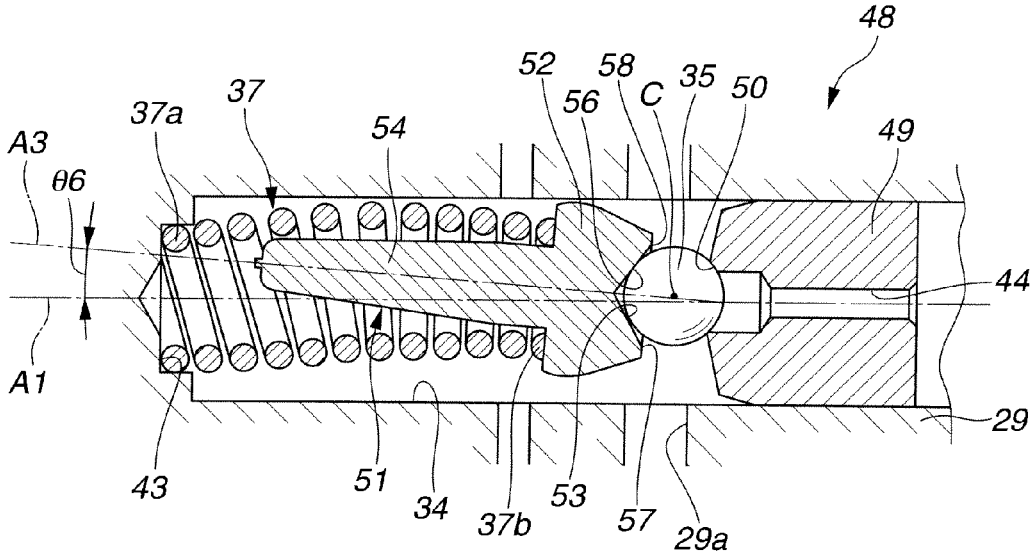
FIG. 11 is a view similar to FIG. 3, but shows a relief valve of the variable displacement vane pump according to a third embodiment of the present invention.
Figure 12:
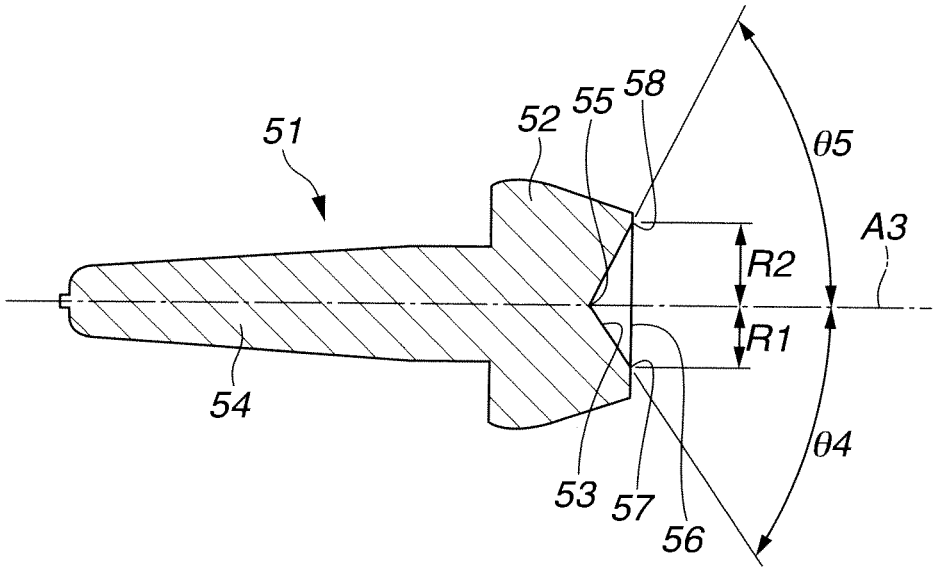
FIG. 12 is a cross section of a valve element retainer of the relief valve shown in FIG. 11.

FIG. 11 is a cross section of the variable displacement vane pump according to a third embodiment, showing a relief valve used in the variable displacement vane pump according to the third embodiment. FIG. 12 is a cross section of a retainer of the relief valve shown in FIG. 11.

The third embodiment shown in FIG. 11 differs from the first embodiment in construction of seat surface 50 of valve seat 49 and construction of ball retaining recess (i.e., valve element retaining recess) 53 formed in ball retaining portion 52 of retainer 51. As shown in FIG. 11, seat surface 50 is formed such that a center of the concave spherical surface constituting seat surface 50 lies on central axis A1 of valve bore 34. Further, ball retaining recess 53 is formed such that center C of ball 35 is located offset from central axis A3 of retainer 51 in a radial direction of retainer 51. Retainer 51 includes shaft portion 54 and has the same construction as that of retainer 39 of the first embodiment except for the above-described structural features.

Specifically, as shown in FIG. 12, ball retaining recess 53 is formed into a generally concave conical shape having deepest portion (i.e., bottom) 55 which is located on central axis A3 of retainer 51 when viewed in the axial section. Ball retaining recess 53 is opened to an end surface of ball retaining portion 52 which is opposed to ball 35, and has circular open end periphery 56 on the end surface of ball retaining portion 52. Ball retaining recess 53 has a radial sectional area which is gradually increased from deepest portion 55 toward open end periphery 56. A radial distance from central axis A3 of retainer 51 to open end periphery 56 is gradually varied along a circumferential direction of open end periphery 56. More specifically, open end periphery 56 includes minimum radius portion 57 having minimum radius R1 and maximum radius portion 58 having maximum radius R2. Minimum radius portion 57 and maximum radius portion 58 are disposed in a diametrically opposed relation to each other. A radius of open end periphery 56 from central axis A3 is gradually increased from minimum radius portion 57 toward maximum radius portion 58 in the circumferential direction. In other words, an opening angle of ball retaining recess 53 with respect to central axis A3 of retainer 51 when viewed in the axial section is gradually varied in the circumferential direction of ball retaining recess 53 such that the opening angle becomes minimum angle θ4 in the circumferential position corresponding to minimum radius portion 57 and the opening angle becomes maximum angle θ5 in the circumferential position corresponding to maximum radius portion 58. With this construction, center C of ball 35 is located offset from central axis A3 of retainer 51 toward the side of maximum radius portion 58.

As a result, similarly to the first embodiment, ball retaining portion 52 of retainer 51 is located offset from the central axis of the other winding seating portion 37*a* of relief valve spring 37 in the radial direction of valve bore 34 so that central axis A3 of retainer 51 is inclined relative to central axis A1 of valve bore 34 by angle θ6 as shown in FIG. 11. Accordingly, the third embodiment can attain substantially the same effect as that of the first embodiment.

Figure 13:
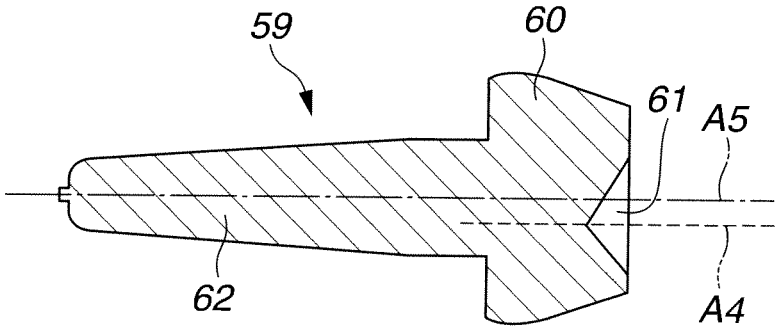
FIG. 13 is a diagram showing a valve element retainer of a relief valve of the variable displacement vane pump according to a modification of the third embodiment.

FIG. 13 is a cross section of a modification of the third embodiment, showing a retainer only.

As shown in FIG. 13, retainer 59 includes ball retaining recess 61 formed in ball retaining portion 60. Ball retaining recess 61 has a generally concave conical shape in rotation symmetrical with central axis A4 of ball retaining recess 61 which is located offset from central axis A5 of retainer 59 in a radial direction of retainer 59. Retainer 59 also includes shaft portion 62 similarly to retainer 51 of the third embodiment. The modification has the same construction as that of the third embodiment except for the above-described structural feature.

With the construction of retainer 59, similarly to the third embodiment, center C of ball 35 is located offset from central axis A5 of retainer 59 in the radial direction of retainer 59. The modification can attain the same effect as that of the third embodiment.

Figure 14:
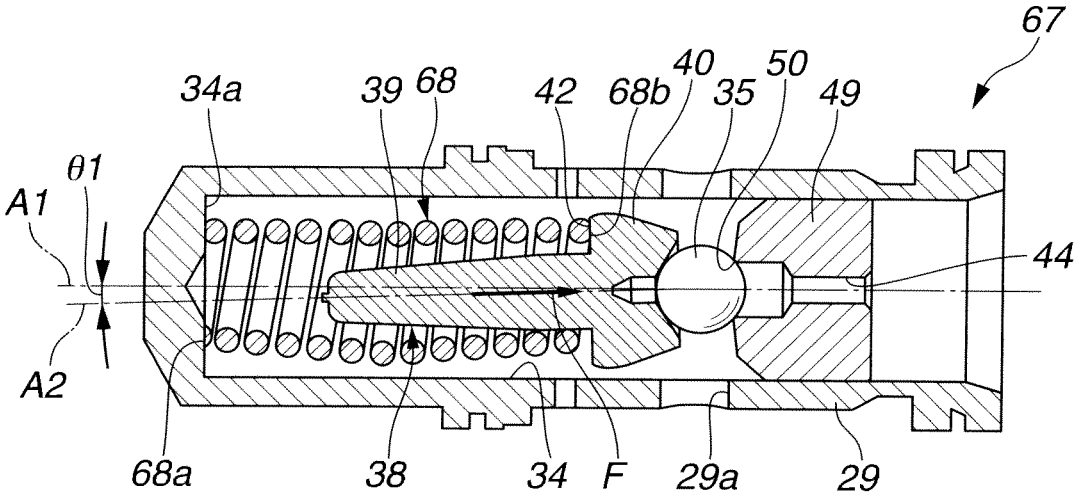
FIG. 14 is a view similar to FIG. 3, but shows a relief valve of the variable displacement vane pump according to a fourth embodiment.
Figure 15:
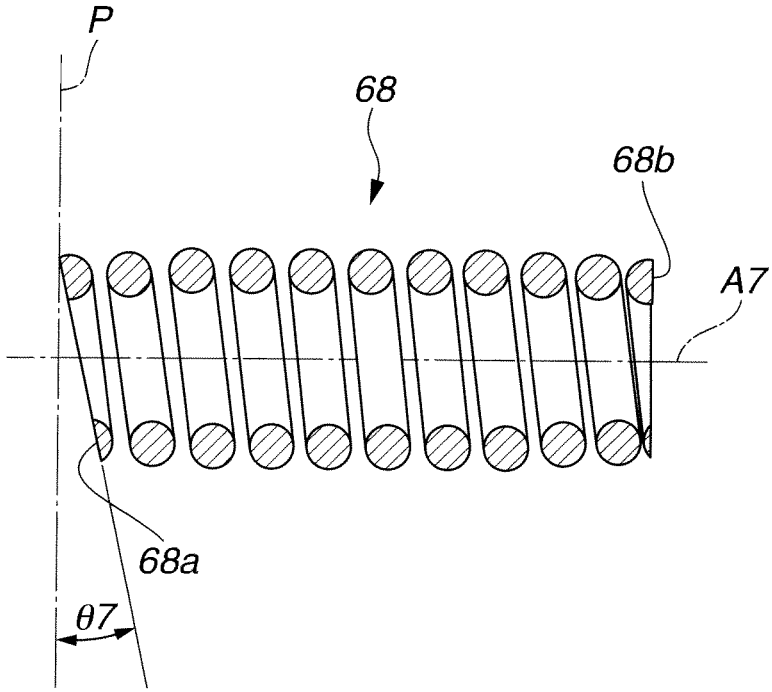
FIG. 15 is a diagram showing a relief valve spring used in the relief valve shown in FIG. 14.
Figure 16:
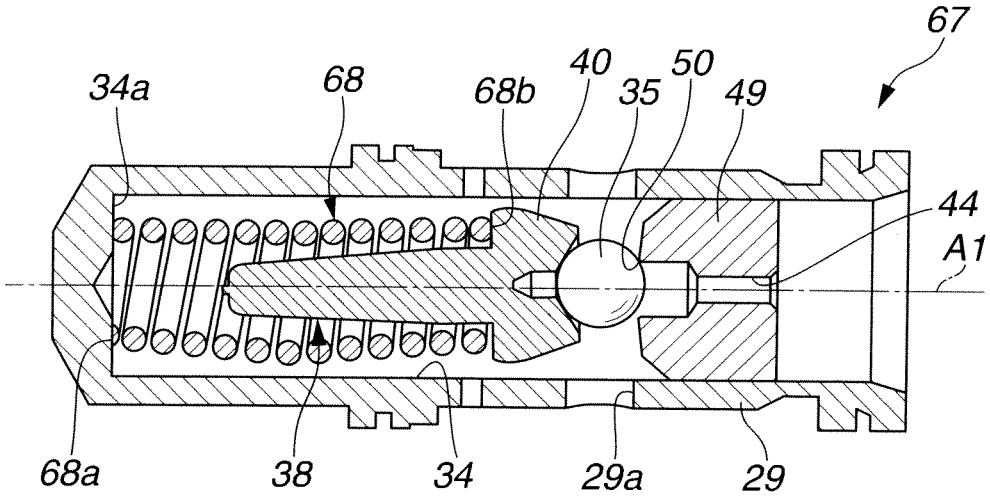
FIG. 16 is a diagram showing an open state of the relief valve shown in FIG. 14.

FIG. 14 to FIG. 16 show a relief valve of the variable displacement vane pump according to a fourth embodiment. In the fourth embodiment, a relief valve spring having a specific structure is used in order to incline the central axis of the retainer relative to the central axis of the valve bore, instead of retainer 51 having the specific ball retaining recess as used in the third embodiment.

Specifically, as shown in FIG. 14, relief valve 67 of the fourth embodiment includes retainer 38 which holds ball 35 such that the center of ball 35 lies on central axis A2 of retainer 38 similarly to the first embodiment. Relief valve 67 further includes relief valve spring 68 in the form of a coil spring which is configured such that in a free state as shown in FIG. 15, one seating surface 68*a* to be seated on bottom surface 34*a* of valve bore 34 is inclined relative to imaginary plane P perpendicular to central axis A7 of relief valve spring 68. In FIG. 15, θ7 indicates an inclination angle of seating surface 68*a* with respect to imaginary plane P. In contrast, the other seating surface 68*b* of relief valve spring 68 which is to be seated on step portion 42 of retainer 38 is in parallel with imaginary plane P in the free state of relief valve spring 68.

When relief valve spring 68 is installed between bottom surface 34*a* of valve bore 34 and step portion 42 of retainer 38 as shown in FIG. 14, relief valve spring 68 is compressively deformed to curve central axis A7 and biases retainer 38 toward valve seat 49 by a restoring force thereof generated owing to the compressive deformation. In this installed state, relief valve spring 68 acts on retainer 38 so as to incline central axis A2 of retainer 38 with respect to central axis A1 of valve bore 34 by angle θ1 and biases retainer 38 toward valve seat 49 by biasing force F exerted along central axis A2 of retainer 38. Thus, relief valve 67 is held in the closed position.

When the hydraulic pressure in through hole 44 of valve seat 49 (i.e., the hydraulic pressure in intermediate pressure chamber 28*b*) is increased to exceed a predetermined relief pressure, ball 35 is moved to separate from one of the radially opposed portions of seat surface 50 of valve seat 49 while keeping contact with the other of the radially opposed portions of seat surface 50 as shown in FIG. 16. Thus, relief valve 67 is brought to the open position. Similarly to the first embodiment, the fourth embodiment can suppress occurrence of vibration of ball 35 when relief valve 67 is moved to the open position. The fourth embodiment can attain substantially the same effect as that of the first embodiment.

Furthermore, other technical concepts and effects of the present invention which are understandable from the above embodiments are described as follows.

(1) In a sixth aspect of the present invention, there is provided the variable displacement vane pump according to the second aspect, wherein the seat surface of the valve seat is formed such that a distance from the other winding seating portion of the relief valve spring to the seat surface of the valve seat in the axial direction of the valve bore is varied in the circumferential direction of the seat surface of the valve seat.

With the construction according to the sixth aspect, the valve element can be more deeply engaged with the valve seat at a portion of the seat surface which has a larger distance from the other winding seating portion of the relief valve spring in the axial direction of the valve bore. As a result, the center of the valve element is located offset from the central axis of the valve bore in the radial direction of the valve bore.

(2) In a seventh aspect of the present invention, there is provided the variable displacement vane pump according to the sixth aspect, wherein the seat surface of the valve seat is inclined relative to the central axis of the valve bore such that a distance from the seat surface of the valve seat to the first winding seating portion of the relief valve spring in the axial direction of the valve bore is gradually increased from one of radially opposed portions of the seat surface of the valve seat toward the other of the radially opposed portions of the seat surface of the valve seat.

With the construction according to the seventh aspect, the one of radially opposed portions of the seat surface of the valve seat is located more apart from the first winding seating portion of the relief valve spring than the other of the radially opposed portions of the seat surface of the valve seat. As a result, the valve element can be more deeply engaged with the valve seat at the one of radially opposed portions of the seat surface, so that the center of the valve element is located offset from the central axis of the valve bore toward the one of radially opposed portions of the seat surface of the valve seat.

(3) In an eighth aspect of the present invention, there is provided the variable displacement vane pump according to the seventh aspect, wherein the seat surface of the valve seat is formed by pressing a punch having a predetermined shape onto the valve seat, and the punch has at least a part of a spherical surface which has a same curvature as that of the spherical surface of the valve element and serves as a forming surface for forming the seat surface of the valve seat.

With the construction according to the eighth aspect, the valve element and the seat surface of the valve seat are brought into surface-to-surface contact with each other. As a result, it is possible to enhance hermetically sealing property of the relief valve in the closed position.

(4) In a ninth aspect of the present invention, there is provided the variable displacement vane pump according to the third aspect, wherein the valve element retaining portion of the valve element retainer includes a valve element retaining recess formed into such a concave conical shape that a diameter of the concave conical shape is gradually increased from a deepest portion of the valve element retaining recess toward an open end periphery of the valve element retaining recess, and the deepest portion of the valve element retaining recess is located offset from a central axis of the valve element retainer in the radial direction of the valve element retainer.

In the construction according to the ninth aspect, since the deepest portion of the valve element retaining recess is located offset from the central axis of the valve element retainer in the radial direction of the valve element retainer, the center of the valve element can be located offset from the central axis of the valve element retainer in the radial direction of the valve element retainer.

This application is based on prior Japanese Patent Application No. 2009-283640 filed on Dec. 15, 2009 and prior Japanese Patent Application No. 2010-230133 filed on Oct. 13, 2010. The entire contents of the Japanese Patent Applications No. 2009-283640 and No. 2010-230133 are hereby incorporated by reference. Although the invention has been described above by reference to certain embodiments of the invention and modifications of the embodiments, the invention is not limited to the embodiments and modifications described above. Further variations of the embodiments and modifications described above will occur to those skilled in the art in light of the above teachings. The scope of the invention is defined with reference to the following claims.

What is claimed is:

1. A variable displacement vane pump comprising:

a pump housing including a pump element accommodating space;

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicating with a suction region in the pump element accommodating space in which a volume of the respective pump chambers is increased with rotation of the rotor;

a discharge passage communicating with a discharge region in the pump element accommodating space in which the volume of the respective pump chambers is decreased with rotation of the rotor;

a hydraulic pressure controller configured to control the eccentric amount of the cam ring with respect to the rotor by controlling a hydraulic pressure in at least one of a pair of fluid pressure chambers formed on radially opposite sides of the cam ring, and a relief valve disposed within the pump housing so as to open and close a hydraulic passage disposed between the discharge passage and the suction passage, the relief valve comprising:

a valve bore disposed within the pump housing;

a spherical valve element disposed in the valve bore;

a valve seat fixedly disposed on one axial side of the valve bore relative to the valve element, the valve seat being formed with a through hole in communication with the discharge passage and disposed coaxially with the valve bore, the valve seat being further formed with an annular seat surface on which the valve element is seated when the relief valve is in a closed position, the seat surface being located on a side of an open end of the through hole, the through hole facing the valve element;

a coil spring disposed on the other axial side of the valve bore relative to the valve element, the coil spring having a first winding seating portion at one axial end thereof which is seated on a bottom of the valve bore coaxially with the valve bore, and a second winding seating portion as the other axial end thereof, and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the oil spring, the valve element retaining portion holding the valve element while restricting a relative radial displacement between the valve element retainer and the valve element, the spring engaging portion restricting a relative radial displacement between the valve element retainer and the second winding seating portion of the coil spring, wherein the seat surface of the valve seat is configured such that when the relief valve is in the closed position, a center of the valve element is located offset from a central axis of the valve bore in a radial direction of the valve bore, and wherein the seat surface of the valve seat is formed such that a distance from the first winding seating portion of the spring of the relief valve to the seat surface of the valve seat in the axial direction of the valve bore is varied in a circumferential direction of the seat surface of the valve seat.

2. The variable displacement vane pump as claimed in claim 1, wherein the seat surface of the valve seat is inclined relative to the central axis of the valve bore such that a distance between the seat surface of the valve seat and the first winding seating portion of the relief valve spring in the axial direction of the valve bore is gradually increased from one radially opposed portion of the seat surface of the valve seat toward another radially opposed portion of the seat surface of the valve seat.

3. The variable displacement vane pump as claimed in claim 2, wherein the seat surface of the valve seat is formed by pressing a punch having a predetermined shape onto the valve seat, the punch having at least a part of a spherical surface which has a same curvature as the spherical surface of the valve element and serves as a forming surface for forming the seat surface of the valve seat.

4. A variable displacement vane pump comprising:

a pump housing including a pump element accommodating space;

a drive shaft rotatably supported by the pump housing;

a rotor disposed within the pump element accommodating space so as to be rotatatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor, a hydraulic pressure controller configured to control the eccentric amount of the cam ring with respect to the rotor by controlling a hydraulic pressure in at least one of a pair of fluid pressure chambers which are formed on radially opposite sides of the cam ring, and a relief valve disposed within the pump housing so as to open and close a hydraulic passage disposed between the discharge passage and the suction passage, the relief valve comprising:

a valve bore disposed within the pump housing;

a spherical valve element disposed in the valve bore;

a valve seat fixedly disposed on one axial side of the valve bore relative to the valve element, the valve seat being formed with a through hole communicated with the discharge passage and with an annular seat surface on which the valve element is seated when the relief valve is in a closed position, the seat surface being located on a side of an open end of the through hole, the through hole facing the valve element;

a coil spring disposed on the other axial side of the valve bore relative to the valve element, and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the coil spring, wherein the valve element retaining portion of the valve element retainer is configured to hold the valve element in a position where a center of the valve element is located offset from a central axis of the valve element retaining portion in a radial direction of the valve element retaining portion, and wherein the valve element retaining portion of the valve element retainer is configured such that when the relief valve is in the closed position, the valve element retaining portion is located offset from a winding seating portion of the coil spring disposed on an opposite side of the seat surface of the valve seat in the radial direction of the valve element retaining portion.

5. The variable displacement vane pump as claimed in claim 4, wherein the valve element retaining portion of the valve element retainer includes a valve element retaining recess formed into such a concave conical shape that a diameter of the concave conical shape is gradually increased from a deepest portion of the valve element retaining recess toward an open end periphery of the valve element retaining recess, and the deepest portion of the valve element retaining recess is located offset from a central axis of the valve element retainer in the radial direction of the valve element retainer.

6. A variable displacement vane pump comprising:

a pump housing including a pump element accommodating space;

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor;

a hydraulic pressure controller configured to control the eccentric amount of the cam ring with respect to the rotor by controlling a hydraulic pressure in at least one of a pair of fluid pressure chambers which are formed on radially opposite sides of the cam ring, and a relief valve disposed within the pump housing so as to open and close a hydraulic passage disposed between the discharge passage and the suction passage, the relief valve comprising:

a valve bore disposed within the pump housing;

a spherical valve element disposed in the valve bore;

a valve seat fixedly disposed on one axial side of the valve bore relative to the valve element, the valve seat being formed with a through hole communicated with the discharge passage and with an annular seat surface on which the valve element is seated when the relief valve is in a closed position, the seat surface being located on a side of an open end of the through hole, the through hole facing the valve element;

a coil spring disposed on the other axial side of the valve bore relative to the valve element; and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the coil spring, wherein the coil spring is configured such that a seating surface thereof to be located on an opposite side of the valve element retainer is inclined relative to an imaginary plane perpendicular to a central axis of the coil spring to thereby incline a central axis of the valve element retainer with respect to a central axis of the valve bore when the relief valve is in the closed position.

7. A variable displacement vane pump comprising:

a pump housing including a pump element accommodating space:

a drive shaft rotatably supported by the pump housing;

a rotor disposed within the pump element accommodating space so as to be rotatably driven by the drive shaft, the rotor having a plurality of vanes disposed to be movable in a radial direction of the rotor, a cam ring disposed on a radial outside of the rotor so as to be movable in such a direction as to vary an eccentric amount of the cam ring with respect to the rotor, the cam ring defining a plurality of pump chambers in cooperation with the respective vanes and the rotor, a suction passage communicated with a suction region in the pump element accommodating space in which a volume of the respective pump chambers is increased with rotation of the rotor;

a discharge passage communicated with a discharge region in the pump element accommodating space in which the volume of the respective pump chambers is decreased with rotation of the rotor;

a hydraulic pressure controller configured to control the eccentric amount of the cam ring with respect to the rotor by controlling a hydraulic pressure in at least one of a pair of fluid pressure chambers which are formed on radially opposite sides of the cam ring, and a relief valve disposed within the pump housing so as to open and close a hydraulic passage disposed between the discharge passage and the suction passage, the relief valve comprising:

a valve bore disposed within the pump housing;

a spherical valve element disposed in the valve bore;

a valve seat fixedly disposed on one axial side of the valve bore relative to the valve element, the valve seat being formed with a through hole communicated with the discharge passage and with an annular seat surface on which the valve element is seated when the relief valve is in a closed position, the seat surface being located on a side of an open end of the through hole, the through hole facing the valve element;

a coil spring disposed on the other axial side of the valve bore relative to the valve element, and a valve element retainer disposed between the valve element and the coil spring so as to urge the valve element toward the valve seat by a restoring force of the coil spring owing to compressive deformation thereof, the valve element retainer including a valve element retaining portion disposed on a side of the valve element and a spring engaging portion disposed on a side of the coil spring, the valve element retaining portion holding the valve element while restricting a relative radial displacement between the valve element retainer and the valve element, the spring engaging portion restricting a relative radial displacement between the valve element retainer and the coil spring, wherein the through hole of the valve seat includes an axial end portion to which the valve element is exposed, the axial end portion having a central axis offset from a central axis of the valve bore, and wherein the seat surface of the valve seat is configured such that when the relief valve is in the closed position, a center of the valve element is located offset from the central axis of the axial end portion of the through hole of the valve seat.

* * * * *